United States Patent [19]

Hirakawa et al.

[11] Patent Number: 4,863,154

[45] Date of Patent: Sep. 5, 1989

[54] CONVEYOR SYSTEM FOR PLANAR OBJECTS

[75] Inventors: Tadashi Hirakawa; Tadashi Yano, both of Mihara, Japan

[73] Assignee: Mitsubishi Jukogyo Kabushiki Kaisha, Tokyo, Japan

[21] Appl. No.: 58,227

[22] PCT Filed: Oct. 9, 1985

[86] PCT No.: PCT/JP85/00559

§ 371 Date: Jul. 21, 1987

§ 102(e) Date: Jul. 21, 1987

[87] PCT Pub. No.: WO87/02341

PCT Pub. Date: Apr. 23, 1987

[30] Foreign Application Priority Data

Mar. 27, 1984 [JP] Japan ..... 59-57232

[51] Int. Cl.[4] ..... B65H 43/00

[52] U.S. Cl. ..... 271/176; 271/265; 271/270; 271/203; 198/460

[58] Field of Search ..... 271/270, 265, 272, 202, 271/203, 314, 176, 227; 198/460, 461

[56] References Cited

U.S. PATENT DOCUMENTS 4,451,027 5/1984 Alper .
4,541,624 9/1985 Sasage et al. ..... 271/270 X
4,632,378 12/1986 Sardella ..... 271/202

FOREIGN PATENT DOCUMENTS 50-124362 9/1975 Japan .
52-42538 9/1977 Japan .
56-20250 5/1981 Japan .
56-27409 6/1981 Japan .
59-97918 6/1984 Japan .

*Primary Examiner*—Joseph J. Rolla
*Assistant Examiner*—Stephen B. Parker
*Attorney, Agent, or Firm*—Wenderoth, Lind & Ponack

[57] ABSTRACT

A conveyor system for reducing the speed of double-piece cut banks being fed to a stacker is provided. Cut-blanks are fed in pairs with the spacing between the blanks of the pair being small and the spacing between the pairs of objects being large along a first conveyor towards a detecting device which detects the leading edge of the blanks. A delivery member consisting of two sandwiching rollers is variably driven in accordance with signals given by the detecting device so as to deliver from the first conveyor the first blank of each pair at a first higher speed and the second blank of each pair at a second lower speed. Blanks are thereby delivered to a second slower conveyor which may be as low as V1=2l/LV2 wherein V2 is the speed of the first conveyor, l is the length of each blank, and L is the distance between the leading edge of a first pair of blanks to the leading edge of a second pair. Blanks are thereby fed slowly to a stacker so as to not damage the blanks, and are also fed in a evenly spaced, non-overlapping, manner.

2 Claims, 4 Drawing Sheets

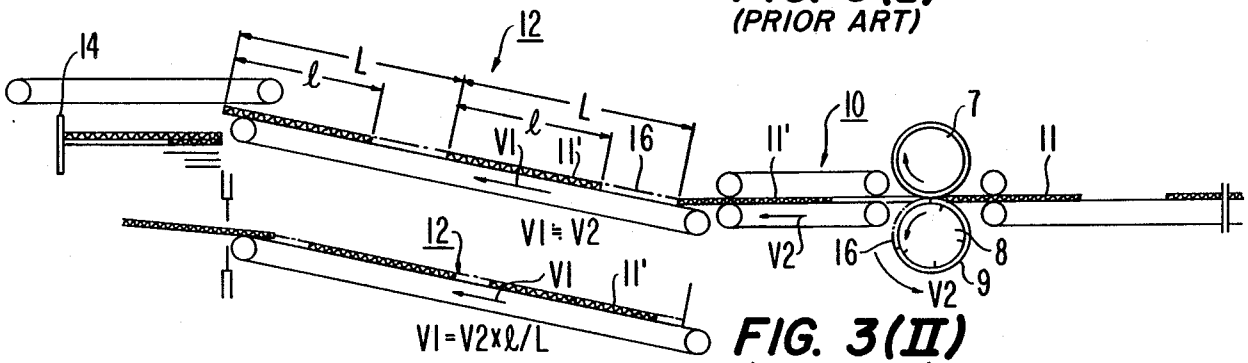
FIG. 3(I) (PRIOR ART)
FIG. 3(II) (PRIOR ART)
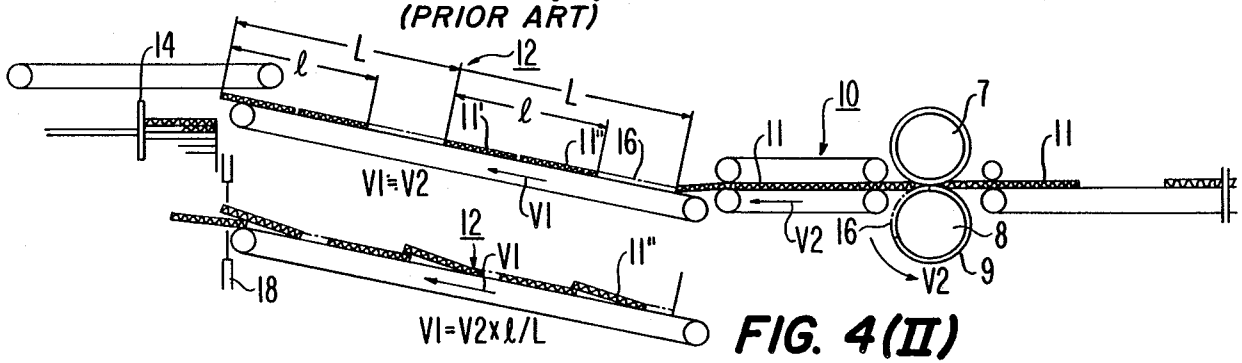
FIG. 4(I) (PRIOR ART)
FIG. 4(II) (PRIOR ART)
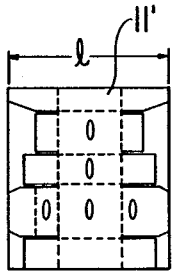
FIG. 3(III) (PRIOR ART)
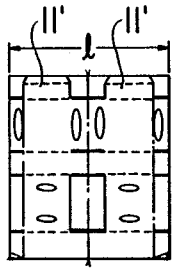
FIG. 4(III) (PRIOR ART)
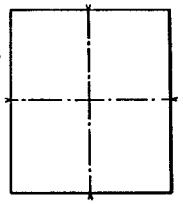
FIG. 4(IV) (PRIOR ART)

CONVEYOR SYSTEM FOR PLANAR OBJECTS

FIELD OF THE ART

The present invention relates to a conveyor system for carrying planar objects by way of a conveyor belt and the like.

BACKGROUND OF THE INVENTION

Corrugated cardboard boxes have been designed with a variety of sizes, shapes and in a variety of multicolor printings these days, and in coping with such designs, there have been presented a variety of functions of the machine for manufacturing the corrugated cardboard boxes, accordingly. Now, referring to the conventional construction of the corrugated cardboard box manufacturing machine with reference to FIGS. 1 through 4, there are shown provided a blank board supply station 1, a first printing machine 2, a second printing machine 3, printing cylinders 4, a transfer conveyor 5, a rotary die cutting station 6, a anvil cylinder 7, a die-cut cylinder 8, a die element 9, a board delivery conveyor (a scrap conveyor; a conveyor for a planar object) 10, a sheet of corrugated board 11, a die board 11' (through the single-cutting process), a died board 11'' (through the double-cutting process), a stacker-conveyor 12, a counter-stacker 13, a board stopper 14, a spacing 16, a lifter 17, and a counting photoelectric tube 18, wherein a sheet of corrugated cardboard 11 is fed for printing by the board supply station 1 with such a rate of delivery of a sheet per single rotation of the printing cylinders 4 in the printing machines 2, 3, thereafter is delivered outwardly by the transfer conveyor 5 for having the printing ink put in the surface of a cardboard 11 dried up, and then is died to a shape of cardboard box by way of the rotary die cutter 6. The die element 9 comprises a cutting knife edge or the like implanted around the circumferential surface of a curved veneer board of a specified thickness, which is to be mounted onto the die-cut cylinder 8 by using bolts, and is adapted to cut and die a sheet of cardboard 11 to be fed from the foregoing step into the nip with the anvil cylinder 7, which is wrapped with a layer of urethane rubber or the like for making the cutting easier and preventing the wear of cutting edge, with a predetermined timing of cuting and dieing. The delivery conveyor (scrap conveyor) 10 is formed by a plurality of such carrier members as V-shaped belts or ropes having a circular section in an attempt to promote the dropping of chippings and cuttings from the product at the area where there is provided a specific means such as an air blower or a vibrator, and is constructed in a duplex structure for carrying the died board 11' in a sandwiched relationship over to a stacker-conveyor 12. There is provided a suction equipment in the stacker-conveyor 12, which is adapted to attract by sucking and deliver the died cardboard 11' at a slow speed in the attempt to reduce a impace shock of the board against the cardboard stopper 14 provided in the counter-stacker 13 when hit, thus obviating a possibility of damages and/or irregular stacking of the cardboards from occurring when stacked upon the lifter 17. Also, the cardboard stopper 14 is designed shiftable back and forth by way of a hydraulic cylinder or the like in accordance with a given width of the died board 11' as schematically shown in FIGS. 1 and 2.

The cardboard box manufacturing machine is of the type that a sheet of cardboard 11 may be set either for one-piece cutting or for longitudinal double-piece cutting according to the size of a box to be died by using the die element 9 of the rotary die cutter 6. FIG. 3(III) shows the case of the single-piece cutting process, FIG. 4(III) shows the longitudinal double-piece cutting, and FIG. 4(IV) shows the four-piece cutting process (double-cuttings in the transversal and longitudinal ways making four pieces of boards), respectively. The die element 9 is to be set in the circumferential surface of the die cut cylinder 8, with a single-piece or double-piece cutting knife element implanted in working position in accordance with the size of a product box to be manufactured, and with a spacing 16. This spacing 16 is provided for the reduction of conveying speed in consideration of a too great shock to be given to the died cardboard 11' when hit against the cardboard stopper 14, which is taken in the following manner; when a series of died cardboards 11' after being died by the die cut cylinder 8 are stacked upon the lifter 17 by using the stacker-conveyor 12, as the carrying speed of the stacker-conveyor 12 will, when the single-piece cutting is conducted (FIG. 3(III)), bring a too large shock on the died sheet 11' when hit against the cardboard stopper 14, if $V_1 \div V_2$ (the circumferential speed of the die cut cylinder 8 and the carrying speed of the delivery conveyor 10 are $V_2$, and the carrying speed of the stacker-conveyor 12 is $V_1$, as shown in FIG. 3(I)), the speed $V_1$ of the stacker-conveyor 12 is then reduced by using the spacing 16 as shown in FIG. 3(II) to:

$$V_1 = V_2 \times \frac{l \text{ (Sheet length for single-cutting)}}{L \text{ (die cut cyl. circumferential length)}}$$

However, in the case of the double-piece cutting process (FIG. 4(III)), when the carrying speed $V_1$ of the stacker-conveyor 12 is reduced down to $V_1 = V_2 \times l/L$ as shown in FIG. 4(II), since the sheet 11'' die for the double-cutting process is cut to the shape in which the foregoing piece and the following piece are left connected with each other by the die cutter, it would not be feasible to have normal cutting operation as these died sheets 11'' may come to overlap one upon the other, and consequently, the carrying speed $V_1$ of the stacker-conveyor 12 is forcibly made $V_1 \div V_2$ as shown in FIG. 4(I) (identical with FIG. 3(I)), then resulting in such undesirable problems that the leading edges of the died sheet 11'' would be damaged by a too large shock load when hit against the cardboard stopper 14 in stacking, or the died sheets 11'' would be stacked irregularly.

DISCLOSURE OF THE INVENTION

In consideration of the problems noted above, it is an object of the present invention to provide an improved conveyor system for planar objects which can obviate such a possibility of damages to be received while being stacked or an inconvenience of irregular stacking in the step following the die-cutting process.

In the conveyor system according to the present invention, there are provided a detecting device adapted to detect the current end position of a planar object fed from the preceding step, a delivery member adapted to deliver the planar object while having it sandwiched therebetween, and a speed change device adapted to change the delivery speed of the delivery member in accordance with the timing of the following step on the basis of the signal from the detecting device, and as the conveying speed of the following stacker-conveyor can be made as slow as $V_1=2\ l/L$ even with the died sheet processed in the double-piece cutting operation, there is attained such advantageous effects as avoiding the risk of damaged rendered at the leading edge of a died sheet or the inconveniences of irregular stacking while being stacked upon the stacker-conveyor in the following step, accordingly.

In addition, there are required only such simple delivery members as two small-diametered sandwiching rolls to be driven for the delivery of the processed sheets, which would have a relatively small inertia value $GD^2$ and therefore require a relatively small capacity driving motor, thus contributing to the curtailment of cost, and which is proven to be adaptable to the double-sheet cutting operation and so useful in the application to the general purpose machine for manufacturing the corrugated cardboard boxes.

The present invention will now be described taking the reference to preferred embodiments thereof shown in the accompanying drawings.

DESCRIPTION OF THE PREFERRED EMBODIMENTS

Figure 1:
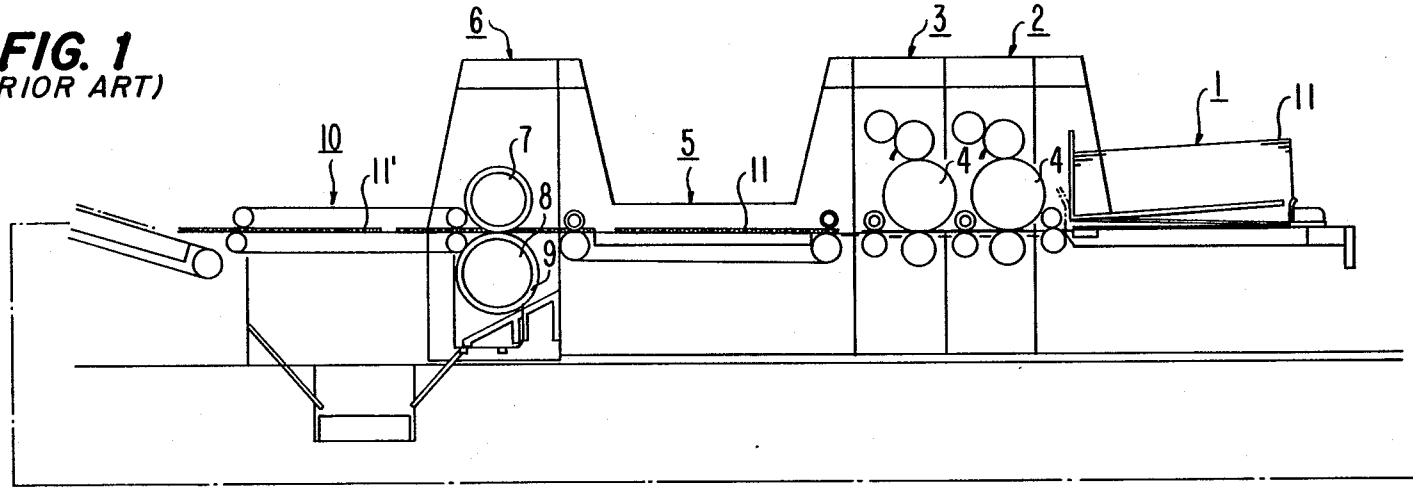
FIG. 1 (PRIOR ART)
Figure 2:
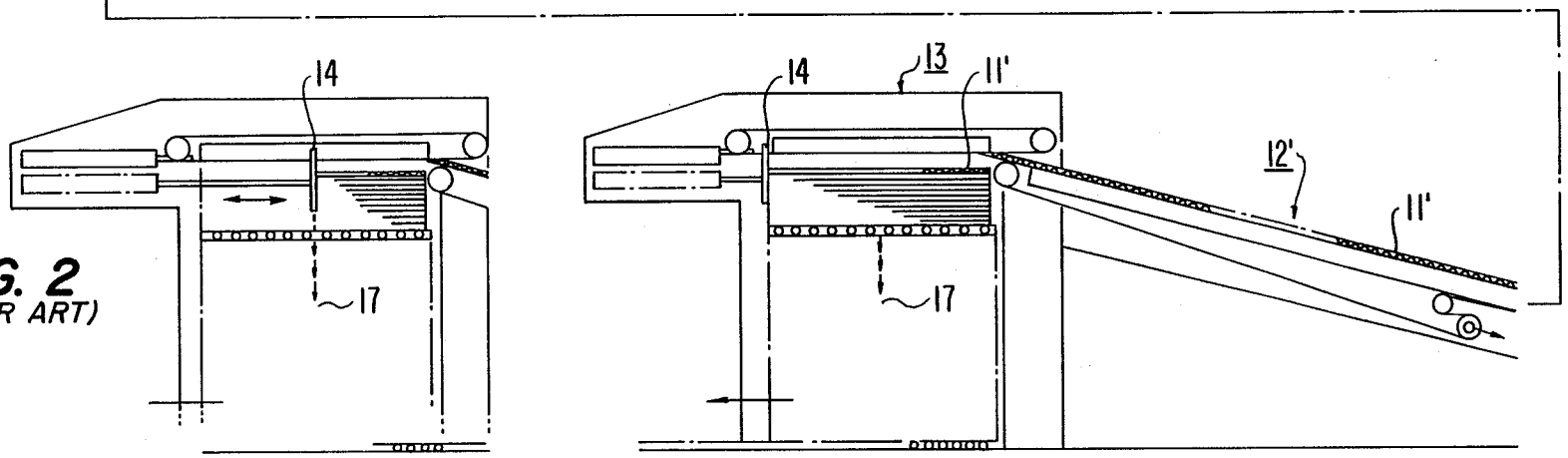
FIG. 2 (PRIOR ART)
Figure 5:
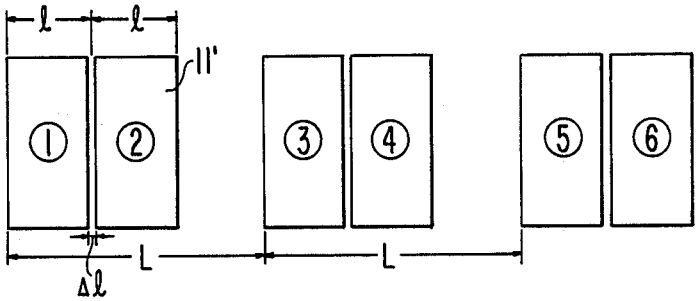
FIG. 5 is a schematic diagram illustrating the mutual relationship of a series of planar objects aligned on the delivery to the delivery member according to the present invention.
Figure 6:
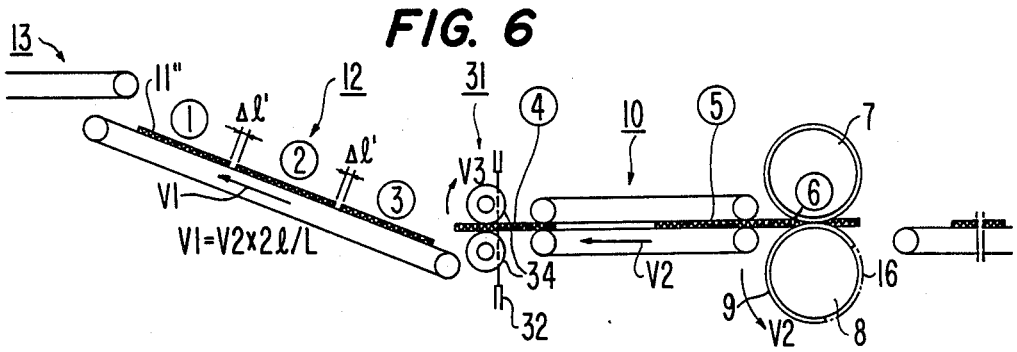
FIG. 6 is a side elevational view showing a preferred embodiment of the conveyor system for the planar objects according to the present invention.
Figure 7:
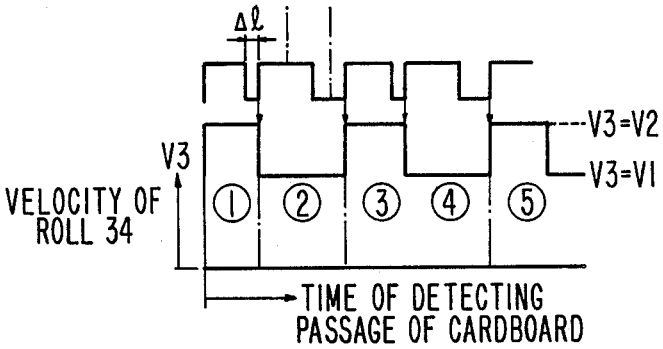
FIG. 7 is an illustrative diagram for depicting the function of the conveyor system.
Figure 8:
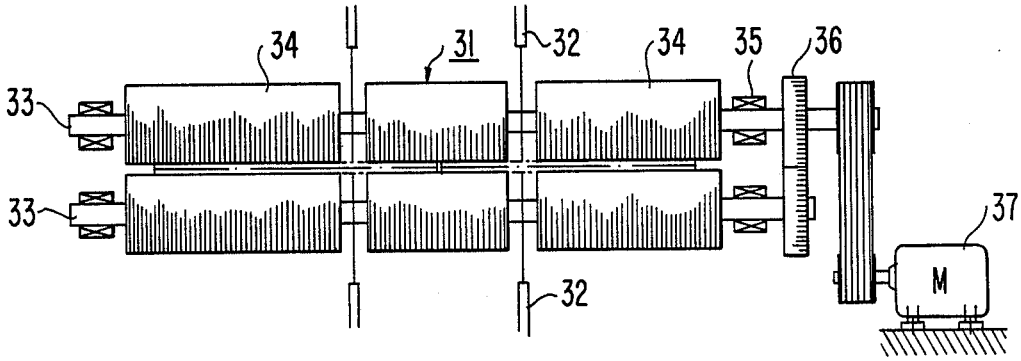
FIG. 8 is a front elevational view showing the speed change device and parts relative thereto of the conveyor system.

Shown in FIG. 6 are an anvil cylinder 7, a die-cut cylinder 8, a die element 9, a sheet delivery conveyor (scrap conveyor) 10, a died sheet (through the double-piece cutting process) 11'', a stacker-conveyor 12, a counter-stacker 13, a spacing 16, an photoelectric tube 32, and a sandwiching roll section 31, and shown in FIG. 8 are sandwich (rubber) roll elements 34, 34, a bearing 35, gears 36, and a DC (variable speed) motor 37. Also, FIG. 5 is a schematic diagram showing a series of died sheets ① through ⑥ before delvered from the sandwich roll elements 34, 34, in which L depicts the circumferential length of the die-cut cylinder 8. Also in FIG. 7 there is shown a timing chart showing the changes of rotating speed of the sandwich roll elements 34, 34. The sandwich roll elements 34, 34 shown in FIG. 8 are fixed in operative position on a single roll shaft 33 disposed with a given gap, and are arranged opposedly to respectively form a pair of rolls in the sandwiching roll section 31. Each of these sandwich roll elements 34 is formed with a layer of soft rubber sheet in its circumference so that it may not squeeze and crush the corrugated cardboard sheets while passing therethrough, and also may be worked with slitting. The upper and lower roll shafts 33 are held rotatably by using the bearings 35 and operatively in such a manner that the cardboard sheet may be carried in a sandwiching manner by the engagement of the sandwich roll elements 34, 34, and on one sides of these roll shafts 33 there are fitted the gears 36 meshing with each other at the ratio of 1:1. On the extension of one end of the roll shaft 33 there is installed a pulley, which is connected operatively to another pulley on the DC motor 37 by using a V-shaped belt or the like; with this arrangement, any change in the rotating speed of the sandwich roll elements 34, 34 may be accomplished by detecting the current edge position of a cardboard sheet to be fed at or near the central portion of the upper and lower sandwich roll elements 34, 34, and by feeding thus-obtained signal into the DC motor 37, and thus changing the rotating speed of the DC motor 37, accordingly.

Next, referring to the operation of the delivery conveyor 10 according to FIG. 5 which shows the state before the died cardboard 11' reaches the sandwich roll elements 34, the sheets ①, ②; ③, ④; ⑤, ⑥ depicts respectively the state of sheets fed from the blank cardboard supply station 1, or in other words the state that these sheets are disposed in a discrete relationship with each other. The spaces between the sheets ② and ③, and between ④ and ⑤ represent a difference in the circumferential length of the die cut cylinder 8 and the overall extension of the died sheets ① and ②. $\Delta l$ represents a small gap produced between each of the adjacent died sheets. The rotating speed (the circumferential speed of the roll surface) $V_3$ of the sandwich roll element 34 (or the rotating speed of the DC motor 37), which may be known by detecting the timing that the edge of the died cardboard 11' passes by using the photoelectric tube 32, is changed as shown in the timing chart of FIG. 7. FIG. 7 shows the relationship between the timing of detecting the passage of the died cardboard 11' by the photoelectric tube 32 (that is, the case that the gap between the adjacent sheets is detected is defined to be the light receiving state, while the case that a sheet is detected being defined to be the light blocking state.) and the current rotating speed of the sandwich roll element 34. The sandwich roll element 34 is driven at the rate $V_3=V_2$ while the sheet ① passes the photoelectric tube 32, and then, upon the blocking of the photoelectric tube 32 by the leading edge of the sheet ②, is reduced down to $V_3=V_1$, or the level of $2\ l/L\times V_2$. Thereafter, the photoelectric tube 32 functions to detect the gap between the sheets ② and ③, and the sandwich roll element 34 are again driven with an increased speed of $V_3=V_2$. With the repetition of such operation, a series of died cardboard 11' may be delivered on the stacker-conveyor 12 at a generally equal interval of $\Delta l'$ one after another, accordingly. The driving speed of the upper and lower sandwich roll elements 34, 34 is increased or reduced with the same speed rate in proportion to the rotating speed $V_2$ of the die cut cylinder 8.

Figure 9:
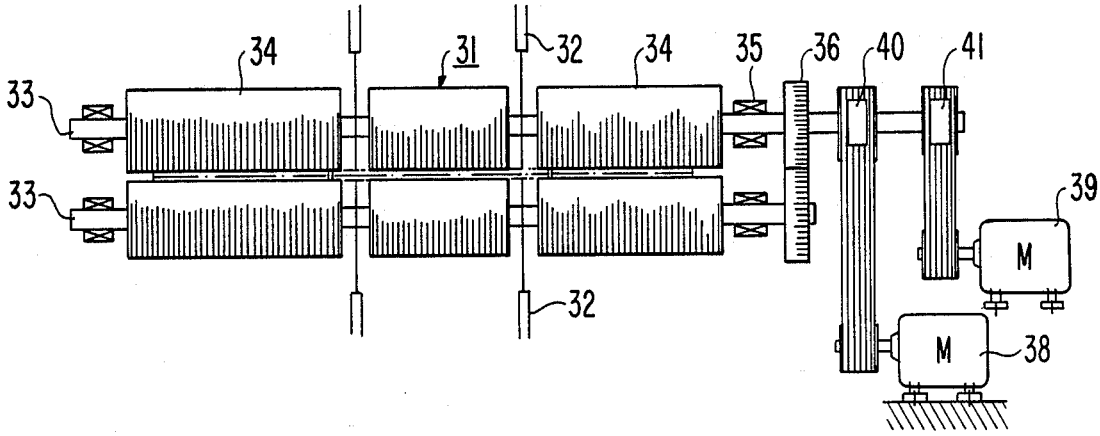
FIG. 9 is a front elevational view showing the same speed change device and parts relative thereto by way of another embodiment.

FIG. 9 shows another embodiment of the invention wherein the rotating speed of the sandwich roll element 34 is changed by shifting a first electromagnetic clutch 40, etc. incorporated or installed otherwise in a motor 38 and a pulley and a second electromagnetic clutch 41, etc. incorporated or installed otherwise in a second motor 39 and a pulley, with which embodiment there is attainable an equivalent effect and function to that of the previous embodiment.

Figure 10:
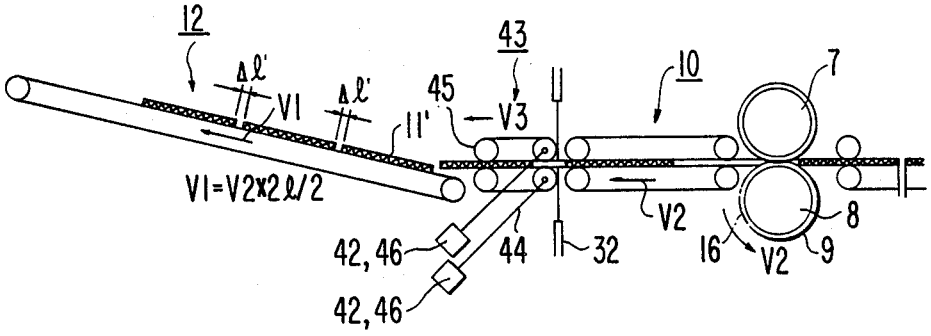
FIG. 10 is a general side elevational view showing the delivery member construction by way of another embodiment.

FIG. 10 shows a further embodiment of the invention, wherein the sandwich roll elements and the speed change device are replaced with a conveyor belt 44, a conveyor roll 45 and a motor 42, with which there is also attainable an equivalent effect and function to that of the embodiment described hereinbefore.

We claim:

1. A conveyor system including means for changing the spacing between planar objects carried on the conveyor system and which start on the conveyor system in pairs with the spacing between the objects of the pair being small and the spacing between the pairs of objects being large, said spacing changing means comprising:

a detecting means for detecting the leading edge of a planar object on said conveyor system and fed from a preceding step, a delivery member positioned along the conveyor system for engaging a planar object of the conveyor system on opposite faces for delivering the engaged object from the conveyor system, a speed change means connected to said delivery member for changing the speed of delivery of said delivery member from a first higher speed during a time from the detection of the passage of a leading edge of a first pair of objects to the detection of the passage of the leading edge of the second object of the said first pair of objects, to a second lower speed of delivery of said delivery member during a time from the detection of the passage of a leading edge of the second object in said first pair of objects to the detection of a leading edge of the pair of objects next succeeding said first pair of objects.

2. A spacing changing means as claimed in claim 1 in which said second lower speed of delivery is a speed V1 and is according to the expression:

$$V1 = V2 \times (2\ l/L)$$

wherein:

V2 is the first higher speed of delivery, l is the length of an object in the direction of movement of the conveyor system, and L is the distance in the direction of movement of the conveyor system from the leading edge of a first pair of objects to the leading edge of the next succeeding pair of objects.

* * * * *